US008696335B2

(12) United States Patent
Fujimoto et al.

(10) Patent No.: US 8,696,335 B2
(45) Date of Patent: Apr. 15, 2014

(54) OIL FREE SCREW COMPRESSOR

(75) Inventors: Hideki Fujimoto, Shizuoka (JP); Hitoshi Nishimura, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 36 days.

(21) Appl. No.: 13/192,592

(22) Filed: Jul. 28, 2011

(65) Prior Publication Data

US 2012/0164017 A1 Jun. 28, 2012

(30) Foreign Application Priority Data

Dec. 24, 2010 (JP) ..... 2010-287769

(51) Int. Cl.
*F04B 23/00* (2006.01)

(52) U.S. Cl.
USPC ..... 417/441; 418/201.1; 418/201.2

(58) Field of Classification Search
USPC ..... 418/201.1, 201.2; 417/295, 440, 441
See application file for complete search history.

(56) References Cited

U.S. PATENT DOCUMENTS 6,679,689 B2 * 1/2004 Takahashi et al. ..... 418/9

FOREIGN PATENT DOCUMENTS

JP 63-61780 A 3/1988
JP 2007-231740 A 9/2007

OTHER PUBLICATIONS

English Translation of Japanese Office Action dated Jan. 14, 2014 (Four (4) pages).

* cited by examiner

*Primary Examiner* — Charles Freay
*Assistant Examiner* — Patrick Hamo
(74) *Attorney, Agent, or Firm* — Crowell & Moring LLP

(57) ABSTRACT

A multi-stage oil-free screw compressor includes: a suction throttle valve for controlling air intake into the compressor; a piston assembly for operating the suction throttle valve; and a structure for supplying a working pressure to the piston assembly. In order to reduce startup load at the time of startup of the compressor, the suction throttle valve is fully closed while a secondary side of a compressor body is opened to the atmosphere. When a negative pressure and the air pressure, that provide the working pressure, are used for slightly opening the suction throttle valve in order to switch the compressor to a loaded mode after a motor for driving the compressor is accelerated to its top speed, the air pressure is provided by a control pipe line that is defined by the same pipe line that forms a drain pipe line. This permits the control pipe line to be opened to the atmosphere as needed during the startup time. Thus is provided the oil-free screw compressor achieving improved startup reliability.

14 Claims, 3 Drawing Sheets

STARTUP

SWITCHING FROM LOAD TO UNLOAD

SHUTDOWN

OIL FREE SCREW COMPRESSOR

CLAIM OF PRIORITY

The present application claims priority from Japanese Patent Application JP 2010-287769 filed on Dec. 24, 2010, the content of which is hereby incorporated by reference into this application.

TECHNICAL FIELD

The present subject matter relates to an oil-free screw compressor.

BACKGROUND

There has been known an oil-free or oilless type screw compressor which is operable to compress air by means of a pair of male and female screw rotors rotatable in a contactless and oilless manner. The oil-free screw compressor includes a compressor body for air compression and is provided with a cooling unit for cooling compressed air because the compressed air discharged from the compressor body has high temperatures. The compressed air discharged from the compressor body flows through pipes running through these cooling unit and compressor unit so as to be discharged to the outside of the compressor unit.

The above oil-free screw compressor includes a suction throttle valve for controlling air intake into the compressor, a piston assembly for operating the suction throttle valve, and a structure for supplying a working pressure to the piston assembly. The screw compressor is further provided with a structure for draining, to the outside of the compressor, condensate resulting from the operations of compressing the air and cooling the compressed air.

Patent Literature 1 (JP-A No. 63(1988)-61780) discloses a capacity controller for a multi-stage compressor, which will be described hereinlater.

SUMMARY

The oil-free screw compressor includes the suction throttle valve for controlling the air intake into the compressor, the piston assembly for operating the suction throttle valve, and the structure for supplying the working pressure to the piston assembly.

The compressor is arranged such that at the time of startup of the compressor, the suction throttle valve is fully closed and a secondary side of a compressor body is opened to the atmosphere in order to reduce start-up load and that the compressor is switched to a loaded mode after a motor for driving the compressor is accelerated to a top speed thereof.

At the time of startup of the compressor, a secondary side of the suction throttle valve is under a negative pressure because the compressor body is driven with the suction throttle valve closed. When the compressor is switched to the loaded mode with air compression yet to be started, as described above, a minor pressure differential between the negative pressure and the air pressure serves as the working pressure on the piston assembly.

However, there may be a case where a required air pressure in a pipe line (hereinafter, referred to as "control pipe line") for supplying the working pressure to the piston assembly of the multi-stage compressor becomes negative due to a configuration of the control pipe line or a configuration or deterioration of some component of the compressor. In this case, the suction throttle valve is unopenable. Therefore, a part of the control pipe line is opened to the atmosphere via an orifice or the like so as to obtain the required air pressure. However, the compressor may encounter condensate leakage from the orifice, flow noises or compressed air leakage because some line segment in the compressor is always open to the atmosphere.

On the other hand, the oil-free screw compressor is provided with the structure for draining, to the outside of the compressor, the condensate resulting from the operations of compressing the air and cooling the compressed air. While drainage is performed for the purpose of preventing the compressor body and the air pipe line from rusting, it is preferred to perform the drainage intermittently in the interest of reducing the compressed air leakage accompanying the drainage.

In an oil-free screw compressor having a structure for controlling the intermittent drainage, an object of the subject matter is to provide a structure wherein the control pipe line for obtaining the required air pressure at the startup of the compressor is defined by the same pipe line that forms a drain pipe line and wherein the control pipe line is opened to the atmosphere only when needed to shift the compressor from a loadless startup mode to the loaded mode, so that the compressor can achieve improved startup reliability and prevent the condensate leakage from the orifice on the control pipe line, the flow noises and the compressed air leakage. Another object of the subject matter is to ensure reliable drainage and to reduce the compressed air leakage accompanying the drainage by allowing for adjustment of drainage interval and drainage time according to the operation conditions of the compressor.

According to an embodiment of the subject matter for achieving the above objects, the oil-free screw compressor has the following structures:

(1) a structure that permits a line segment of the control pipe line to be opened to the atmosphere by opening a drain valve;

(2) a structure that permits adjustment of the drainage time and/or the drainage interval in on-off operations of the drain valve; and (3) a structure that permits the above drainage time and drainage interval to be set according to the operation conditions or shutdown condition of the compressor at the time of startup, loaded mode (load operation), loadless mode (unload operation) or shutdown.

In the oil-free screw compressor adapted to control the air intake into the compressor by means of the suction throttle valve, the subject matter provides the draining structure that ensures the improved startup reliability and rust prevention.

BRIEF DESCRIPTION OF THE SEVERAL VIEWS OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

A two-stage oil-free screw compressor according to an example is described as below.

Figure 3:
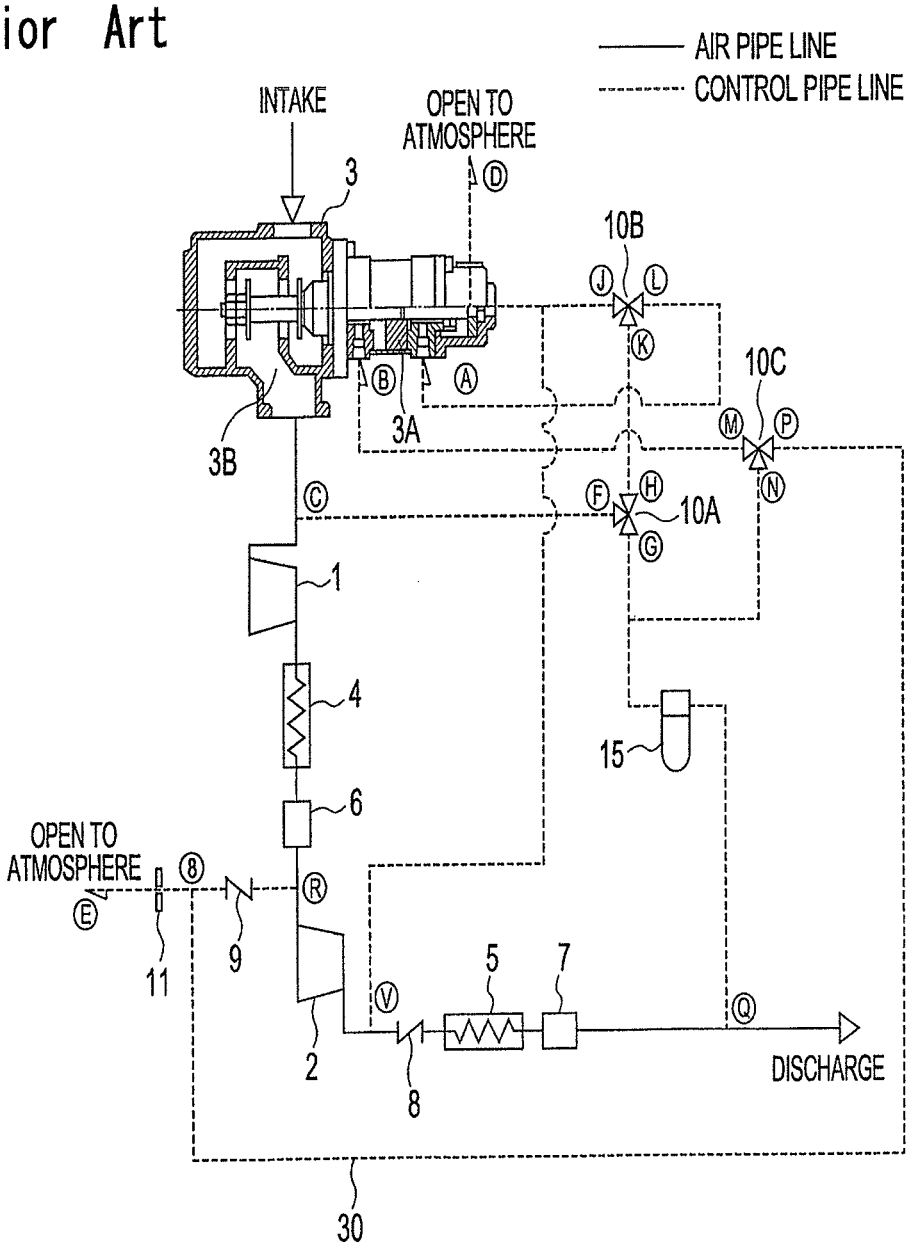
FIG. 3 Prior Art
FIG. 3 is a diagram showing a configuration of a conventional control pipe line.

Now, description is made on a conventional two-stage oil-free screw compressor which is illustrated in FIG. 3 for comparison purpose.

FIG. 3 shows an air pipe line extended from an air-intake to an outlet of the compressor and a pipe line (hereinafter, referred to as "control pipe line") for control of working pressure on a suction throttle valve. The dashed line in the figure represents the control pipe line while the solid line represents the air pipe line.

FIG. 3 shows a low-pressure compressor stage 1; a high-pressure compressor stage 2; a suction throttle valve 3 for controlling air intake into the compressor; a piston assembly 3A; a low-pressure heat exchanger stage for cooling compressed air; a high-pressure heat exchanger stage 5 for cooling the compressed air; a low-pressure drain separator 6; a high-pressure drain separator 7; check valves 8 and 9; three-way solenoid valves 10A, 10B and 10C; and an orifice 11.

The low-pressure compressor stage 1 is provided with the suction throttle valve 3 on a suction side thereof. Disposed downstream of the low-pressure compressor stage 1 is the low-pressure heat exchanger stage 4. The low-pressure drain separator 6 is disposed downstream of the low-pressure heat exchanger stage 4. The high-pressure compressor stage 2 as the final compressor stage is disposed downstream of the low-pressure drain separator 6. A discharge pipe line from the high-pressure compressor stage is provided with the check valve 8, the high-pressure heat exchanger stage 5 and the high-pressure drain separator 7, leading the compressed air to the outlet port.

A line segment (Q) extends from a point downstream of the high-pressure heat exchanger stage 5 and the high-pressure drain separator 7 and connects to the three-way solenoid valves 10A, 10C via a control pipe line filter 15 (These components are referred to as "first operation pipe line system").

A line segment (R) extends from a point downstream of the low-pressure heat exchanger stage 4 and the low-pressure drain separator located on the discharge side of the low-pressure compressor stage 1. Branched from the line segment (R) is an operation pipe line 30 including the check valve 9 and the orifice 11 (These components are referred to as "second operation pipe line system"). The operation pipe line system is connected to the three-way solenoid valve 10C.

Therefore, the three-way solenoid valve 10C is capable of operating a chamber (B) of the suction throttle valve 3 with air pressure introduced through the line segment (Q) and also operating the chamber (B) of the suction throttle valve 3 with air pressure introduced through the line segment (R). A line segment (V) extends from a point between the high-pressure compressor stage 2 and the check valve 8, connecting to the three-way solenoid valve 10B (This line segment is referred to as "third operation pipe line system").

In the above arrangement, a valving element of the throttle valve is opened or closed by controlling the piston assembly 3A with the working pressure. It is noted that a line segment (V) to (D) is opened to the atmosphere when the suction throttle valve is closed.

Now, operations at the startup of the compressor are described with reference to FIG. 3.

At startup, the suction throttle valve 3 is closed to reduce startup load so that the compressor does not suck in air. With the valving element of the suction throttle valve 3 closed, screw rotors of the low-pressure compressor body 1 and of the high-pressure compressor body 2 are driven into rotation by motors so as to start air suction into the compressor bodies. Hence, an air pipe line segment between a secondary-side chamber 3B of the suction throttle valve and a primary side of the low-pressure compressor body 1 is placed under negative pressure.

Similarly, an air pipe line segment between a secondary side of the low-pressure compressor body 1 and a primary side of the high-pressure compressor body 2 is also placed under negative pressure. After startup the motor is accelerated to its top speed and then, the suction throttle valve is opened as follows. The negative pressure is supplied to a chamber A of the suction throttle valve 3 and the air pressure is supplied to a chamber B thereof so that a pressure differential therebetween is used for slightly opening the valving element thereof (slightly open position). In practice, an air line segment C is communicated with the chamber A by means of the three-way solenoid valve 10A and the three-way solenoid valve 10B so as to place the chamber A under the negative pressure. At this time, the chamber B is communicated with a control pipe line (S) by means of the three-way solenoid valve 10C. Air compression is started by slightly opening the valving element of the suction throttle valve 3 so that the low-pressure compressor body 1 and the secondary side of the high-pressure compressor body 2 are placed under positive pressure. The airpipe line (Q) is communicated with the chamber B of the suction throttle valve 3 whereby a pressure differential between the chamber A and the chamber B is exerted to fully open the valving element.

Now, description is made on an action of an unloader of the two-stage compressor.

It is noted that the suction throttle valve 3 is fully closed at startup. This is because the compressor is designed to make sure to utilize released air to close the suction throttle valve at the time of shutdown and also to inhibit the suction throttle valve 3 from operating on its own after the shutdown. During a startup unload operation, the three-way solenoid valve 10A is OFF while the three-way solenoid valves 10C, 10B are ON. It is assumed here that COM-NO ports are communicated when the three-way solenoid valve is OFF and that COM-NC ports are communicated when the three-way solenoid valve is ON. In FIG. 3, the solenoid valve 10A includes an NC port (F), an NO port (G) and a COM port (H); the solenoid valve 10B includes an NC port (K), a COM port (L) and a NO port (J); and the solenoid valve 10C includes an NO port (N), an NC port (P) and a COM port (M).

The air pressure from the line segment (Q) is introduced into the chamber A via the three-way solenoid valves 10A, 10B while the suction throttle valve 3 is closed. In the meantime, the line segment (R) is under the negative pressure.

When a command to cancel the startup unload operation is inputted, all the three-way solenoid valves are ON (COM-NC ports are communicated) for several seconds after the load switching. The pressure in the chamber (A) of the suction throttle valve 3 becomes negative just as in the chamber (3B) and hence, a pressure differential between the chamber (A)

and the chamber (B) causes an unloader piston and a valve spindle (neither of which is shown) to move rightward so that the suction throttle valve 3 starts to open.

When the suction throttle valve 3 is slightly opened, an intermediate stage is increased in pressure and the air pressure is supplied to the chamber (B) through the line segment (R), the control pipe line 30 and the three-way solenoid valve 10C. The air pressure acts to move the unloader piston and valve spindle thereby fully opening the suction throttle valve 3. When the suction throttle valve 3 is fully opened to place the compressor in load operation mode (full load operation), the three-way solenoid valves 10A, 10B are switched ON while the three-way solenoid valve 100 is switched OFF. Namely, the three-way solenoid valve 10C is switched to open the ports NO-COM thereof so that the compressor performs the load operation wherein the working pressure is supplied to the chamber (B) through the line segment (Q) and the pipe line.

Next, description is made on a function of the orifice 11 shown in FIG. 3. At startup, the secondary side of the low-pressure compressor body 1 and the primary side of the high-pressure compressor body 2 are under the negative pressure, as described above. While the valving element of the throttle valve is slightly opened by the pressure differential between the negative pressure of the chamber A and the air pressure of the chamber B, the check valve 9 is provided in order to avoid a situation that the line segment (R) is communicated with the chamber (B), the pressure of which goes negative. Further, in case that leakage occurs due to the aged-deterioration of the check valve or the like, the orifice 11 is provided to open a line segment (E) to the atmosphere thereby preventing a segment between a line segment (S) and the chamber B from being placed under the negative pressure. The orifice 11 is interposed in a line segment between (R) and (E) because the compressed air is discharged from this line segment whenever the air compression is started to place the secondary side of the low-pressure compressor body 1 and the primary side of the high-pressure compressor body 2 under the positive pressure.

The orifice 11 may suffer clogging if the diameter thereof is excessively decreased to reduce leakage of the compressed air. Further, the orifice 11 involves a fear of draining condensate therefrom if the low-pressure drain separator 6 is unable to fully separate the condensate from the air discharged from the low-pressure heat exchanger stage 4. What is more, the compressed air leaked from the orifice 11 produces noises constantly.

According to the embodiment, a pipe line that permits the line segment (S) to (E), shown in FIG. 3, to be opened to the atmosphere as needed and that drains the condensate can be implemented by defining the line segment (E) open to the atmosphere via the orifice 11 interposed in this line segment (S) to (E) shown in FIG. 3 by the same pipe line that forms a drain pipe line.

The example is described with reference to FIG. 1. Hereinafter, components not specifically described correspond to those shown in FIG. 3, which are explained only once to avoid repetition.

According to the embodiment, a drain pipe line (T) to (U) for low pressure stage is extended from place between a secondary side of the low-pressure drain separator 6 and a primary side of the air pipe line (R).

Figure 1:
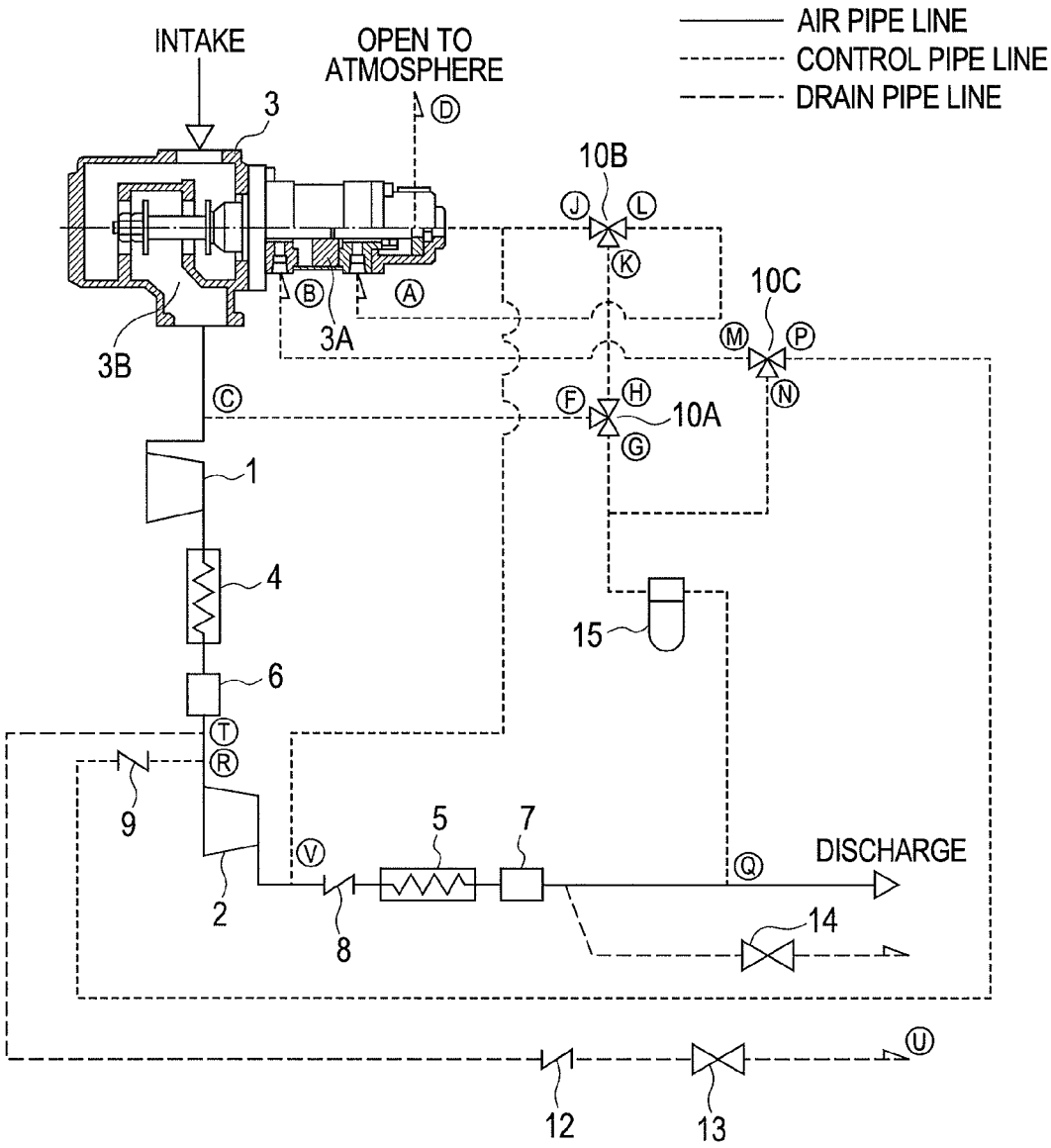
FIG. 1 is a diagram showing a control pipe line and a draining structure according to an example.

In FIG. 1, an electrically on-off controllable solenoid valve 13 according to the embodiment is interposed in the drain pipe line (T) to (U). The point (U) is open to the atmosphere for drainage. The drain pipe line (T) to (U) serves dual purposes of opening the compressor to the atmosphere at startup and draining the condensate from the low pressure stage.

FIG. 1 shows a check valve 12, and a condensate drain solenoid valve 14 disposed downstream of the high-pressure drain separator.

Now, description is made of the on-off control of the drain solenoid valve 13.

Figure 2A:
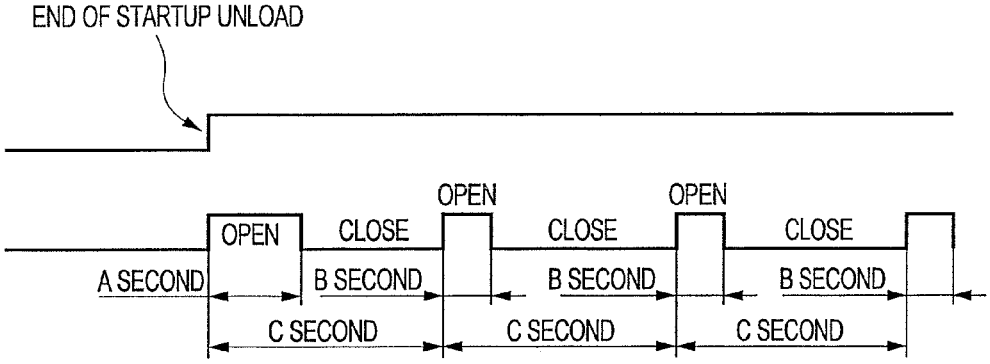
FIG. 2A is a chart showing timing sequence of drainage control when startup.
Figure 2B:
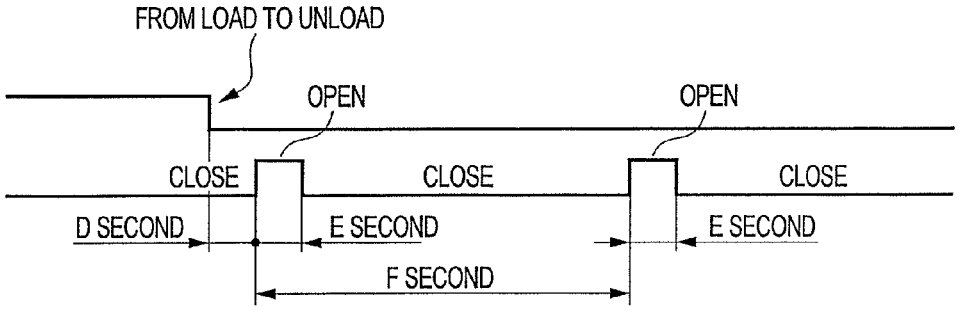
FIG. 2B is a chart showing timing sequence of drainage control when switching from load to unload.
Figure 2C:
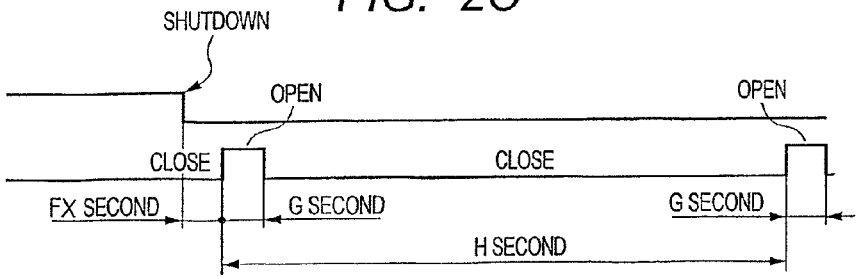
FIG. 2C is chart showing timing sequence of drainage control when shutdown.

FIG. 2A to 2C illustrates an exemplary on-off operation of the drain solenoid valve 13 by way of a timing chart.

In the timing chart of FIG. 2A to 2C, an upper part shows an operation of the solenoid valve at the time of startup, an intermediate portion shows an operation at the time of switching from the load operation to the unload operation, and a lower part shows an operation at the time of shutdown. In these chart portions, individual open and close operations represent the operations of the drain solenoid valve 13.

After startup, the drain solenoid valve 13 is kept open for a period of A second, as shown in FIG. 2A, in which, with the valving element of the suction throttle valve 3 fully closed, the motor is accelerated to its top speed (end of the startup unload operation) and then the valving element of the suction throttle valve 3 is slightly opened. Subsequently, the condensate is drained by on-off controlling the drain solenoid valve 13 while adjusting a drainage interval C and a drain-valve open time B according to the drainage discharge. It is preferred that the drainage interval C and the drain-valve open time B can be set arbitrarily because the drainage interval C and the drain-valve open time B vary depending upon the cooling capacity of the heat exchanger and the temperature, moisture and the like of the intake air.

After switching from the load (loaded) operation to the unload (loadless) operation and during the shutdown time shown in FIGS. 2B and 2C, the drainage discharge decreases from the drainage discharge during the load operation and hence, the open time for the drain valve can be set shorter while the close time therefor can be set longer. It is also preferred that the respective time lengths D to G are set arbitrarily.

During the shutdown time, the switching operation of the drain solenoid valve 13 is continued because the condensate may be formed by condensation in the heat exchanger and the pipe lines when the temperature in the compressor drops after the shutdown.

In FIG. 2A to 2C, the lengths of time A, B, D, E are on the order of 1 to 3 seconds, that of time C on the order of 30 seconds, that of time F on the order of 180 seconds and that of time H on the order of 600 seconds, which may vary depending upon the types of compressors.

According to the above embodiment, an oil-free screw compressor having the structure ensuring high startup reliability can be provided.

While the foregoing has described what are considered to be the best mode and/or other examples, it is understood that various modifications may be made therein and that the subject matter disclosed herein may be implemented in various forms and examples, and that teachings may be applied in numerous applications, only some of which have been described herein. It is intended by the following claims to claim any and all applications, modifications and variations that fall within the true scope of the present teachings.

What is claimed is:

1. An oil-free multi-stage compressor comprising:

a low-pressure compressor body, a high-pressure compressor body, a motor for driving the low-pressure compressor body and the high-pressure compressor body, the motor including an air suction part for controlling an amount of suction air for the low-pressure compressor body, and a suction throttle valve for controlling air intake into the compressor, controlled by pressure differential of working pressures supplied, moved by the air suction part, and operated by a piston assembly, a first path for supplying one of the working pressures from an air flow passage connecting the suction part and the low-pressure compressor body, a second path for supplying one of the working pressures from an air flow passage connecting the low-pressure compressor body to the high-pressure compressor body, a third path for supplying one of the working pressure from an air flow passage connecting the high-pressure compressor body and a user side, a fourth path for providing communication with atmosphere and the air flow passage connecting the low-pressure compressor body to the high-pressure compressor body and draining condensate included in compressed air discharged from the low-pressure compressor body to outside of the multi-stage compressor, and a control element situated in the fourth path for controlling the communication and the condensate draining, wherein, when the multi-stage compressor is driven in a start up, unloaded condition, the suction throttle valve is fully closed by the working pressure supplied via the third path, wherein, when the multi-stage compressor switches a driving operation from the start up, unloaded operation to a loaded operation after the motor is accelerated to a top speed, the working pressure is supplied to the air suction part via the first path instead of via the third path, and the control element permits the communication between the fourth path and the atmosphere in order to open the throttle valve slightly.

2. The oil-free multi-stage compressor according to claim 1, wherein the control unit prohibits the communication between the fourth path and atmosphere after a predetermined time passes.

3. The oil-free multi-stage compressor according to claim 2, wherein the control unit permits the communication between the fourth path and the atmosphere for a predetermined time interval.

4. The oil-free multi-stage compressor according to claim 2, wherein, after the multi-stage compressor switches from the loaded operation to the unloaded operation, the control element prohibits the communication between the fourth path and the atmosphere for a predetermined time, and then permits communication between the fourth path and the atmosphere for a predetermined time.

5. The oil-free multi-stage compressor according to claim 2, wherein, after the multi-stage compressor switches from the loaded operation to the unloaded operation, the control element prohibits the communication between the fourth path and the atmosphere for a predetermined time, and then permits communication between the fourth path and the atmosphere for a predetermined time after a predetermined time interval.

6. The oil-free multi-stage compressor according to claim 2, wherein, after the multi-stage compressor switches from the start up, unloaded operation to the loaded operation or from the loaded operation to a shutdown operation, the control unit prohibits the communication between the fourth path and the atmosphere for a predetermined time, and then permits the communication between the fourth path and the atmosphere for a predetermined time.

7. The oil-free multi-stage compressor according to claim 2, wherein, after the multi-stage compressor switches from the start up, unloaded operation to the loaded operation or from the loaded operation to a shutdown operation, the control unit prohibits the communication between the fourth path and the atmosphere for a predetermined time, and then permits communicative connection between the fourth path and the atmosphere for predetermined time after a predetermined time interval.

8. The oil-free multi-stage compressor according to claim 7, wherein the predetermined time is shorter than the predetermined time interval.

9. The oil-free multi-stage compressor according to claim 5, wherein the predetermined time is shorter than the predetermined time interval.

10. The oil-free multi-stage compressor according to claim 3, wherein the predetermined time is shorter than the predetermined time interval.

11. The oil-free multi-stage compressor according to claim 8, wherein the predetermined time and the predetermined time interval can be set arbitrarily.

12. The oil-free multi-stage compressor according to claim 5, wherein the predetermined time and the predetermined time interval can be set arbitrarily.

13. The oil-free multi-stage compressor according to claim 3, wherein the predetermined time and the predetermined time interval can be set arbitrarily.

14. The oil-free multi-stage compressor according to claim 1, wherein at least one of the low-pressure compressor body and the high-pressure compressor body is a screw-type compressor.

* * * * *